US006915595B2

(12) United States Patent
Kastner

(10) Patent No.: US 6,915,595 B2
(45) Date of Patent: Jul. 12, 2005

(54) RESILIENT, ALL-SURFACE SOLES FOR FOOTWEAR

(76) Inventor: Sidney Kastner, 9590 rue Clement, La Salle, Quebec (CA), 8 HR IT2

( * ) Notice: Subject to any disclaimer, the term of this patent is extended or adjusted under 35 U.S.C. 154(b) by 0 days.

(21) Appl. No.: 10/613,575

(22) Filed: Mar. 22, 2004

(65) Prior Publication Data

US 2004/0134102 A1 Jul. 15, 2004

Related U.S. Application Data

(63) Continuation of application No. 09/948,597, filed on Sep. 10, 2001, now abandoned.

(51) Int. Cl.[7] ..... A43B 23/28

(52) U.S. Cl. ..... 36/59 R; 36/61; 36/67 R; 36/59 C

(58) Field of Search ..... 36/61, 59 R, 67 R, 36/59 A–59 C, 67 A–67 D, 134

(56) References Cited

U.S. PATENT DOCUMENTS 19,205 A * 1/1858 Pollard ..... 36/61
2,258,734 A * 10/1941 Brady ..... 36/59 R
2,424,226 A * 7/1947 Dufour ..... 36/59 C
3,747,238 A * 7/1973 Jankauskas ..... 36/61
4,271,608 A * 6/1981 Tomuro ..... 36/61
4,466,205 A * 8/1984 Corbari ..... 36/134
4,747,220 A * 5/1988 Autry et al. ..... 36/59 R
5,634,283 A * 6/1997 Kastner ..... 36/61
5,768,802 A * 6/1998 Bramani ..... 36/28
6,029,377 A * 2/2000 Niikura et al. ..... 36/67 R
6,082,024 A * 7/2000 Del Biondi ..... 36/28
6,698,110 B1 * 3/2004 Robbins ..... 36/61

* cited by examiner

*Primary Examiner*—Marie Patterson
(74) *Attorney, Agent, or Firm*—Walter D. Ames

(57) ABSTRACT

A resilient shoe sole having a less resilient outer layer and a more resilient inner layer, and retractable studs anchored in the inner, more resilient layer. The bottom surface of the sole has annular grooves formed around the tip portions of the studs to permit those portions to flex when pressure is applied to the bottom surface, as during walking on a hard surface.

8 Claims, 4 Drawing Sheets

RESILIENT, ALL-SURFACE SOLES FOR FOOTWEAR

This application is a continuation of Ser. No. 09/948,597 filed on Sep. 10, 2001 now abandoned.

FIELD OF THE INVENTION

The present invention relates to improvements in resilient, all-surface soles that are applied to or or are integral part of footwear. More specifically, it relates to improvements in such soles as described, illustrated and claimed in my U.S. Pat. No. 5,634,283, which was issued on Jun. 3, 1997.

BACKGROUND OF THE INVENTION

As more fully disclosed in U.S. Pat. No. 5,634,283, on which I am the named inventor and the disclosure of which is hereby fully incorporated herein by referende, it has long been a challenge to those of skill in the art of designing footwear to devise footwear having soles that enable the wearer to have traction on surfaces that may be classified as slippery, e.g., ice or wet sod. With regard to the lastter surfaces, golf shoes are a common expedient. Gold shoe normally have soles with metal spikes or studs that extend at right angles to the bottom surface of the sole, so that when the golf shoes are worn on sod, the spikes readily penetrate the sod to a depth such that, when the golfer exerts downward pressure on the shoe sole, the footwear remains in a fixed position relative to the sod despite substantial torque that is applied by the golfer during his swing.

It will be apparent, however, that while shoes having soles with spikes extending outwardly from them are quite useful when one is walking on sod, or even a surface such as ice or compacted snow, when one then stands on a hard, smooth surface into which the spikes can make no substantial penetration, such spiked footwear can be a hazard to the wearer as well as the hard surface, which can be defaced and scratched by the shoe spikes.

In order to address this problem my prior patent disclosed and claimed a footwear sole formed from a resilient material such as rubber and having a plurality of metal studs mounted in the sole, each stud or spike having an anchoring poortion embedded in the resilient sole, a tip portion extending outwardly from the sole surface, and a shaft portion joining the tip and the anchor of the stud. When the footwear is worn, the studs are retracted inwardly from the surface of the sole so that on a hard surface, the tip portions of the studs will be located at the relatively hard surface and will not penetrate it. However, when the wearer is standing on a relatively soft surface, such as sod or wet ice, the studs will extend outwardly from the sole a distance sufficient to enable the wearer to obtain purchase on that softer surface due to penetration of the studs into the surface.

While that invention is broadly utilitarian, i6 does not address problems that may arise in specific situations. Thus, where a woman's shoe is to be made with such a sole, it is apparent that pressure on the resilient sole will be less than that exerted by a shoe where the wearer is a 300-lb. man. Moreover, if the sole is formed from rubber or other material of a high degree of resilience such tht when the shoe is worn by a lightweight person the studs will nevertheless retract to the bottom surface of the sole, the sole formed from such soft rubber may not present a firm support to the wearer. In addition, even when there is an optimum balance between the resilience of the sole and the weight of the wearer, there still may be some scarification of a hard surface when the wearer i of the shoes slides his or her feet across that surface.

It is, therefore, one object of the present invention to provide a studded sole for footwear in which the resilience of the sole at its bottom, work-contacting surface is not necessarily determinative of the resistance of the sole to retraction of the studs while the footwear is being worn.

Expressed otherwise, it is an object of my invention to overcome the problem of adapting a studded, resilient sole to varying surface and weights of the wearer so that the studs will readily engage surfaces on which they are designed to penetrate, but nevertheless enable the wearer to utilize the shoes or other footwear on a hard surface, such as a tile floor, without unduly marring that surface.

SUMMARY OF THE INVENTION

In one broad aspect of my invention, it comprises utilizing studs that have an anchoring portion interior of the sole and adapting that portion of the sole that engages the anchoring portion of the stud to the specific conditions toward which the stud is designed. This requires that the sole not have a uniform resilience or density, because it is not formed from rubber or other material that is uniformly resilient. Thus, the resilience of the rubber will vary through the depth of the sole as that depth is measured from the bottom, work-contacting surface of the sole to that sole surface that contacts the upper of the footwear.

In one specific embodiment the sole is formed so that the resilience thereof varies between the bottom and upper surfaces of the sole. Such variation can be uniform, that is, more resilient at the bottom, work-contacting surface of the sole and least resilient at the portion of the sole that contact the shoe upper. In another embodiment the sole is formed from layers of rubber, a more resilient zone being located at the bottom of the sole even at the uppermost zone, with a less resilient, i.e., harder zone being formed at a central location to lend stability to the shoe. Yet in another embodiment the more resilient zone can be located between the two, harder zones of rubber. It is in this softer zone of rubber that the anchoring portion of a stud is located; in this manner an easily retractable stud is formed although the work contacting surface of the sole is relatively hard, so that the sole may be worn on a hard, indoor surface without unduly scuffing it.

In order to provide for the same, general purpose, another embodiment of my invention is based on the formation of a groove in the bottom, work contacting surface of the sole. Such groove is annular in shape and surrounds the tip of a stud that projects from the bottom surface. As the stud has a degree of resilience, itself, the groove permits the stud to flex to the side when excess pressure is directed against it, rather than have the additional pressure on the study force the stud into a hard underlying surface which it will then tend to scar.

With respect to processes for the manufacture of soles that have varying degrees of resilience through their depths, the soles can be formed in a single molding operation in which the resilient material, such as natural or synthetic rubber, has its composition varied from one surface of the sheet from which the soles are formed to the other surface. Alternatively, the sole can be molded from individual sheets. For example, two sheets of less resilient and one sheet or more resilient can be formed and cut to size, and the more resilient layer sandwiched between the harder layers and molded to them. Production efficiencies may determine which methods of forming the desired structures prove more effective.

These and other objects, features and advantages of the present invention will become more apparent when considered in connection with preferred embodiments of my invention as described in the specification hereinafter and as illustrated in the accompanying drawings, in which.

DETAILED DESCRIPTION OF PREFERRED EMBODIMENTS

Figure 1:
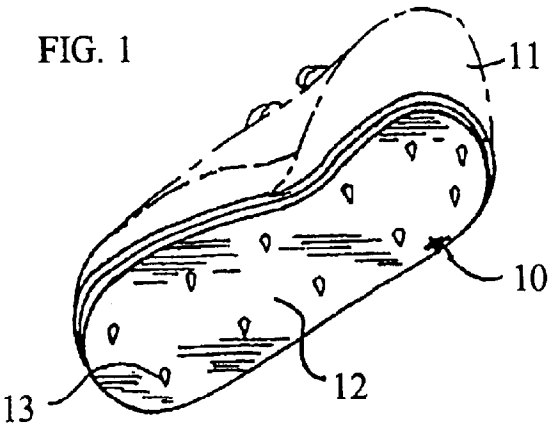
FIG. 1 is a perspective view generally showing the exterior of footwear having an all-surface sole according to my invention.

Referring now to the drawings, and in particular to FIG. 1 thereof, what is shown in an all-surface sold 10 in place on footwear 11. Sole 10 may be permanently attached to shoe 11 or may be removable therefrom and placed, either with another, similar sole after excessive wear, or with another sole that has different characteristics.

As generally shown, sole 10 has a bottom, work-contacting surface 12, from which protrude a plurality of metal studs 13. The upper surface 14 of the sole is not seen in FIG. 1, but lies in juxtaposition to the upper of the shoe 11. The pattern in which the studs 13 are arranged is predetermined and is not considered to be part of the present invention.

Figure 3:
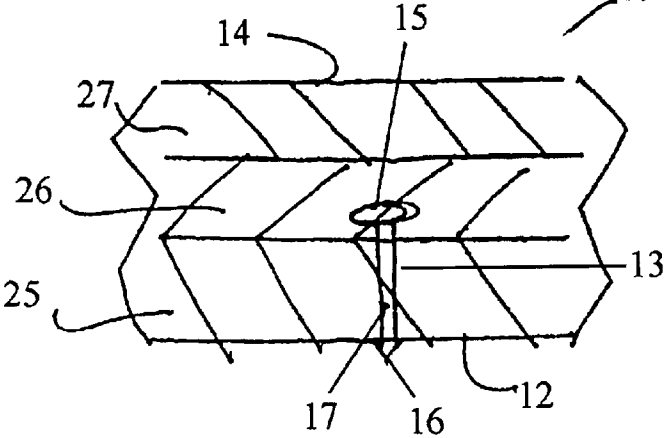
FIG. 3 is an enlarge sectional view illustrating another preferred embodiment of a sole construction according to my invention.
Figure 2:
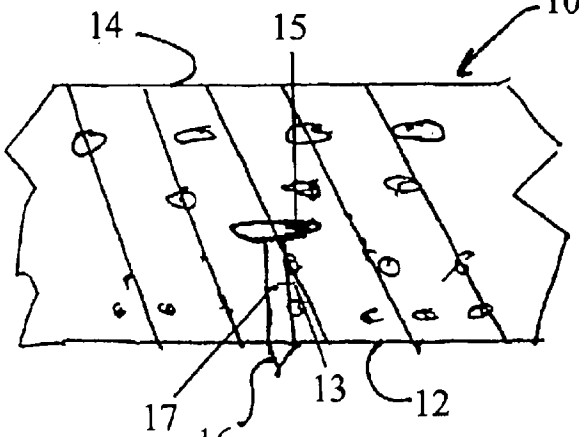
FIG. 2 is an enlarged sectional view illustrating the sole construction according to one preferred embodiment of my invention.

The structure of a stud 13, which is preferably made of metal, is best seen in FIGS. 2 and 3. As is the case with the studs of my U.S. Pat. No. 5,634,283, each stud 13 is formed with an anchoring portion 15, a tip portio 16, and a cylindrical or conical shank or shaft portion 17 so that it will remain substantially in place in relation to the resilient material of the sole in which it is encased. The tip 16 may be of a variety of shapes so long as its function of engaging a surface on which the wearer of the footwear 11 places it is maintained. Thus, the tip portion 16 is shown as cylindrical, but may also be conical with the apex of the cone projecting outwardly from the bottom surface 12 of the sole 10. The shaft 17 serves the function of connecting the tip and anchor of a stud. Indeed, the tip portion may simply be constituted as the extremity of the shaft 18.

What is important to certain embodiments of my resilient, all-surface sole is the nature of the composition of the sole 10. In my patent it is disclosed, but not limited to being uniform and made from a resilient material, e.g., natural or synthetic rubber. In the embodiment of FIG. 2 the material from which the sole is formed is of the same general, resilient nature, but the sole is not uniform in substance or resiliency. The rubber body of the sole is harder, that is, of less resilience, at a location adjoining the bottom, work contacting surface 12 of the sole 10. More dense, less resilient zones of the sole are indicated by reference number 20 and adjoin bottom surface 12. Less dense portions are indicated by reference number 21 and adjoin upper sole surface 14. Portions of intermediate density lie between the zones 20 and 21, and are indicated by reference numeral 22. As a consequence, in that illustrated embodiment the density of the sole 10 decreases from the sole bottom surface 12 to the sole upper surface 14, and in this embodiment it is preferred that such decrease be uniform in its extent, that is, that the resilience of the sole uniformly increases as one moves from the bottom surface 12 to the upper surface 14 of the sole 10.

In the FIG. 2 embodiment it will also been seen that the anchoring portion 15 of the stud 13 is embedded in the rubber sole approximately halfway between the bottom and top sole surfaces. In this position the anchor 15 is located at a part of the thickness of the sole that is of lesser density and greater resilience than that portion 20 adjoining bottom surface 12. In this structure the stud 13 will be able to be retracted more easily when the user of the footwear 22 steps on a hard surface than if the resilience of the sole were uniform throughout its depth. Yet the hardness of the rubber at the bottom surface of the sole will still be of greater density, and therefore provide greater wear resistance and sturdiness to the footwear. However, retraction of the stud will still be adequate if the wearer of the shoe is of light weight, for example.

The illustration of FIG. 3 shows a different, preferred embodiment. Here harder rubber layers are disposed adjoining both surfaces of the sole 10. Thus, a relatively hard layer 25 is located at the bottom surface 12 of the sole and, similarly, hard layer 27 is located at the upper surface 14 of the sole. However, those relatively hard layers have between them a softer, more resilient layer or zone 26, which in effect is sandwiched between the more dense layers.

The reason for the layering of more and less resilient zones in the FIG. 3 embodiment is to enable the stud 13 to be retracted more easily into the sole 10, while still maintaining a relatively firm sole bottom surface that will resist undue wear. Thus, in this embodiment of my invention the shaft 17 of stud 13 extends through the less resilient portion 26 and into the more resilient portion 27, in which the anchor 15 of stud 13 is located. While in FIG. 3 the anchor is illustrated as embedded in the more resilient layer 26, it can also be positioned at the juncture of less resilient layer 25 and more resilient layer 26. In this manner the stud is more readily retractable because its anchor portion 15 is encased within and/or cushioned by the more resilient zone 26. Still, the less resilient outer layer 25 adjoining the bottom surface 12 of the sole 10 is in contact with the work, i.e., the surface on which the wearer is striding. In this manner ease of retractability of the stud or spike is enhanced while the wear resistance of the footwear is the same as if the denser bottom layer of the sole extended throughout the entirety of the sole.

Figure 4:
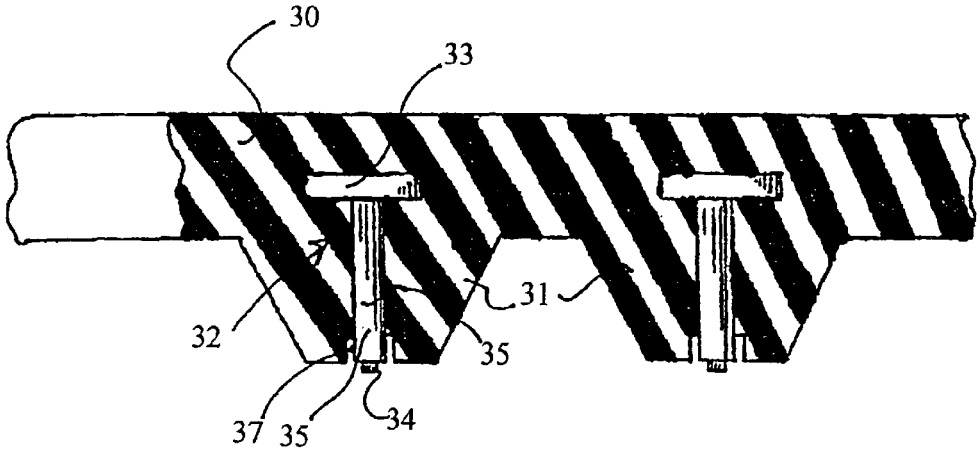
FIG. 4 is an enlarged sectional view of a third, preferred embodiment.

Still another embodiment of my invention is illustrated in FIG. 4 of the drawings. Here the sole 30 is formed of a single zone of rubber, and a cleat portion 31 extends downwardly and forms, in part, the bottom surface of the sole. Encased within the body of the sole is a stud 32, comprised of an anchor 33 and a tip 34 joined by a shaft 35 that extends substantially perpendicular to the horizontal axis of the sole 30. What is believed to be unique vis-a-vis my prior patent, however, is the groove 37 that surrounds the tip and forms an annular opening about the tip 34 and in this case a lower portion of the shaft 35. As the shaft of the stud 32 is usually formed from metal, providing such an annular recess 37 enables some flexing of the stud when it contacts a hard surface, and such flexing prevents unwanted scarification of that surface in addition to the resilience imparted by the stud anchor 33 embedded in the resilient sole 30.

Figure 5:
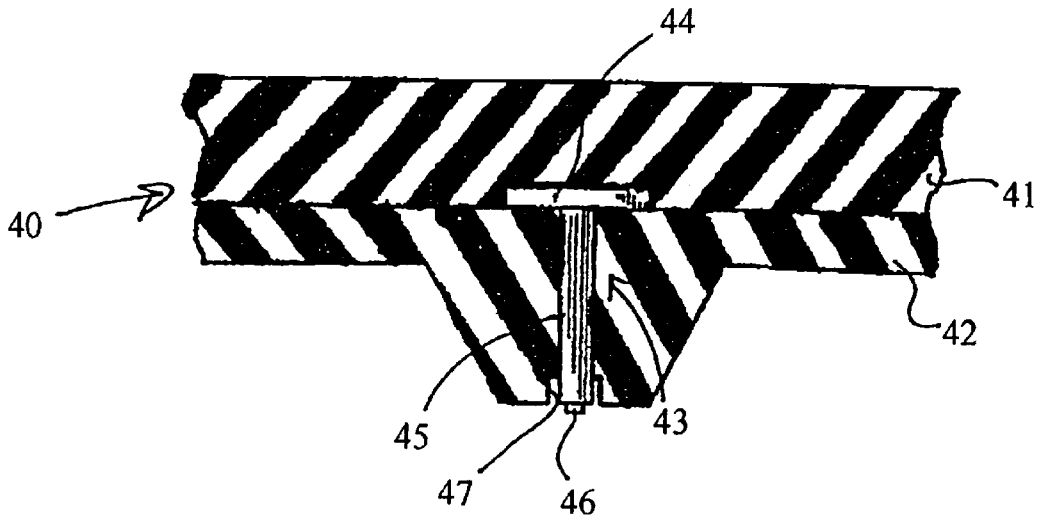
FIG. 5 is another section illustrating a variant of the embodiment of FIG. 4.

FIG. 5 shows another preferring embodiment of my invention that is similar to that of FIG. 4. The difference here is that the sole 40 is formed from two layers of rubber, an upper or inner layer 41 and an outer, work contacting zone or layer 42. A stud 43 is provided, which stud includes an anchor 44 joined by a shaft 45 to a stud tip 46. Here, too, the tip 46 is surrounded by annular recess 47 to permit some flexing of the tip and associated shank 45. In the FIG. 5 embodiment outer layer or zone 42 is of harder, more wear resistance material, while inner layer 41 is more resilient. So, as the anchoring portion 44 of stud 43 is backed by more resilient zone 41, the stud can be retracted far more easily than if it had to press against the harder, less resilient zone 42.

Figure 6:
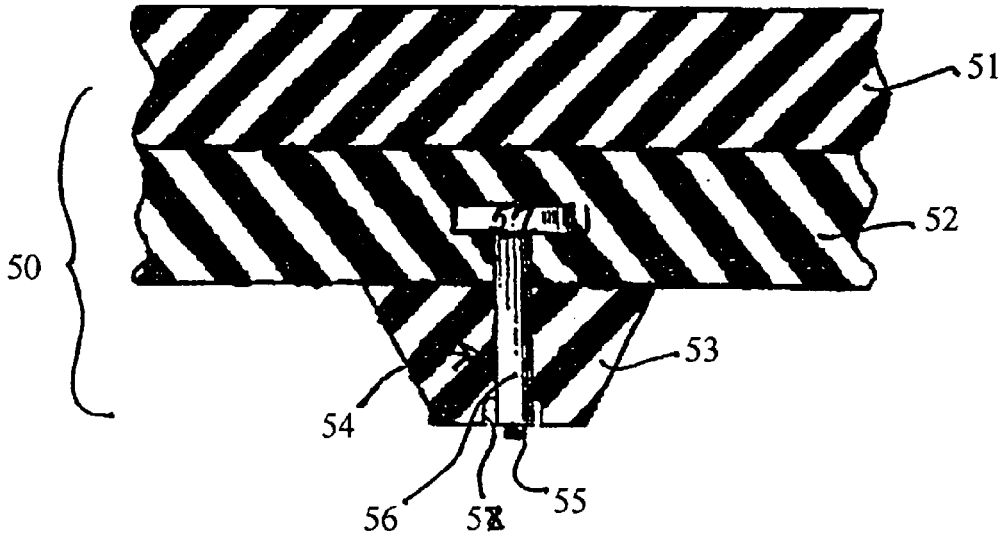
FIG. 6 is still another sectional view showing a variation that comprises a combination of previously illustrated preferred embodiments.

Finally, the embodiment illustrated in FIG. 6 employs another combination of hard or more resilient layers of rubber. In this embodiment sole 50 is formed from a relatively hard upper layer 51 of rubber or other material, to which is adhered a relatively resilient layer 52. Then a cleat 53 formed of relatively hard rubber protrudes downwardly from the resilient layer 52. The stud 54 extends with its tip 55 in hard layer 53 and shaft 56 passing through that hard layer into zone 52 in which its anchor 58 is encompassed. In this structure the stud 54 can be retracted with a fair degree of ease, as its anchor need only compress a part of the more resilient layer 52 while both the work contacting cleat 53 and the upper layer 51 of the sole 50 are formed from a less resilient material adapted to provide great wear resistance and rigidity to the sole in its entirety. In this embodiment as well, the annular recess 57 permits some flexibility of the tip and tip 55 and shaft 56 of the stud 54.

With regard to the manufacture of the soles disclosed herein, they can be made by molding in one piece or, where the sole is formed from layers of materials of difference degrees of resilience, by separately forming each layer and then fusing the layers together. The hardness of the synthetic or natural rubber compounds utilized will vary as set forth in U.S. Pat. No. 5,634,283, from between about 65 to 90 Durometer Shor A. Where greater hardness and less resilience are desired, the sole hardness will be at a maximum, whereas where much more resilience is desired, the Shor Durometer hardness will be at a minimum. Nevertheless, such variation in hardness are doubtless within the skill of those in this art, and I do not wish to be limited as to any specific hardness or resilience employed, other than as such hardness or resilience in one part of the sole may be contrasted with those factors in another layer of the sole.

It will be apparent to those of skill in this art that certain modifications and alterations to the preferred embodiments of my invention described and illustrated herein will be found obvious without departing from the spirit of the invention. Exemplarily, the provision or deletion of a cleat from the bottom surface of the sole is an obvious expedient. It is desired, therefore, that all such alterations and modifications be included within the purview of the invention, which is to be limited only by the scope, including equivalents, of the following, appended claims.

I claim:

1. A resilient, all-surface solo for footwear, said sole having a bottom, work contacting surface and an upper surface sad being formed from a resilient material of substantial thickness located between said surface and being subject to compressive deformation, comprising:

a plurality of studs mounted in said sole, each of said studs having an anchor portion embedded in said resilient material, a tip portion extending slightly beyond the plane of said bottom surface of said sole, and a shaft connecting said anchor portion and said tip portion, said resilient material being non-uniform in its degree of resilience and being less resilient at an exterior portion at said bottom surface of said sole and more resilient at an interior portion of said sole, said anchor portion being embedded in said sole at said more resilient portion and having a body of said more resilient material positioned between it and said upper surface, so that when said footwear is worn and compressive deformation is applied to said bottom surface of said sole, said tip portion is caused to retract within said sole by force directed by said stud anchor against said more resilient interior portion while said less resilient exterior portion of said sole provides wear resistance when said bottom surface of said sole contacts hard surfaces as said footwear is worn.

2. A sole as claimed in claim 1, in which said resilient material is in the form of layers, a less resilient layer being located at a lower portion of said sole and terminating in said bottom, work contacting surface of said sole and a more resilient layer being located at an upper portion of said sole adjacent said less resilient layer.

3. A sole as claimed in claim 2, in which said anchor portion of said stud is positioned at said more resilient layer.

4. A sole as claimed in claim 2, in which said anchor portion of said stud is embedded in said more resilient layer.

5. A sole as claimed in claim 1, in which said resilient material is in the form of layers, a first, less resilient layer being located at a lower portion of said sole and terminating in said bottom, work contacting surface of said sole, a more resilient layer located at and contiguous with said less resilient layer and extending upwardly therefrom, and a second, less resilient layer contiguous with said more resilient layer, said first and second less resilient layers being adhered to and sandwiching said more resilient layer between them, said stud anchor portion being located at said more resilient layer and having a body of said more resilient layer positioned between it and said upper surface.

6. A sole as claimed in claim 5, in which said stud anchor is embedded in said more resilient layer.

7. A sole as claimed in claim 5, in which said stud anchor is positioned at the juncture of said first less resilient layer and said more resilient layer.

8. A resilient, all-surface sole for footwear, said sole having a bottom, work contacting surface and an upper surface and being formed from a resilient material of substantial thickness located between said surfaces and being subject to compressive deformation, comprising:

a plurality of studs mounted in said sole, each of said studs having an anchor portion embedded in said resilient material, a tip portion extending slightly beyond the plane of said bottom surface of said sole, and a shaft connecting said anchor portion and said tip portion, said resilient material being non-uniform in its degree of resilience and being learn resilient at an exterior portion at said bottom surface of said sole and more resilient at an interior portion of said sole, said anchor portion being embedded in said sole at said more resilient portion, said bottom surface of said sole being formed with a recess at the location where said tip portion extends outwardly from the plane of said bottom surface, so that when said footwear is worn and compressive deformation is applied to said bottom surface of said sole, said tip portion is caused to retract within said sole by force directed by said stud anchor against said more resilient interior portion and said tip portion flexes in said recess formed at said location where said tip portion extends beyond said sole surface while said less resilient exterior portion of said sole provides wear resistance when said bottom surface of said sole contacts a hard surface as said footwear is worn.

* * * * *